United States Patent [19]

Gundjian

[11] Patent Number: 4,867,481

[45] Date of Patent: Sep. 19, 1989

[54] ANTI-PHOTOCOPYING PAPER AND/OR ANTI-TELEFACSIMILE PAPER

[75] Inventor: Arshavir Gundjian, Montreal, Canada

[73] Assignee: Nocopi International Inc., New York, N.Y.

[21] Appl. No.: 160,048

[22] Filed: Feb. 24, 1988

[30] Foreign Application Priority Data

Feb. 27, 1987 [GB] United Kingdom ..... 8704664

[51] Int. Cl.[4] ..... B42D 15/00; G09F 3/03; B41M 3/14; B41M 1/20

[52] U.S. Cl. ..... 283/91; 283/902; 427/7; 428/916

[58] Field of Search ..... 283/74, 91, 92, 93, 283/94, 902; 427/7, 162, 258, 165; 428/201, 203, 916; 430/10, 56, 127

[56] References Cited

U.S. PATENT DOCUMENTS

| | | | |
|---|---|---|---|
| 3,675,948 | 7/1972 | Wicker | 283/902 |
| 4,277,514 | 7/1981 | Sugiura et al. | 283/902 |
| 4,325,981 | 4/1982 | Sugiura et al. | 283/902 |
| 4,420,175 | 12/1983 | Mowry | 283/902 |
| 4,506,916 | 3/1985 | Kuhl | 283/91 |
| 4,522,429 | 6/1985 | Gardner et al. | 283/91 |
| 4,568,141 | 2/1986 | Antes | 283/91 |
| 4,582,346 | 4/1986 | Caprio et al. | 283/902 |
| 4,632,429 | 12/1986 | Gardner et al. | 283/91 |

*Primary Examiner*—Douglas D. Watts
*Assistant Examiner*—Paul M. Heyrana, Sr.
*Attorney, Agent, or Firm*—Robert F. Delbridge; Arne I. Fors

[57] ABSTRACT

Paper is provided with resistance to photocopying or transmission by telefacsimile by spatial spectral modulation of the paper reflectance at a specific single or preferably multiple frequencies. Such paper has a colored pattern of at least two colors repeating in at least one dimension of a face of a paper with at least one frequency in the range of from about 0.5 to about 50 times per cm. The colors contrast with black or similar dark color to permit black or similar dark colored information to be visible readable when applied to the colored pattern. The colors also cooperate with such information to provide a document resistant to photocopying and transmission by telefacsimile.

15 Claims, 7 Drawing Sheets

ANTI-PHOTOCOPYING PAPER AND/OR ANTI-TELEFACSIMILE PAPER

Figure 1:
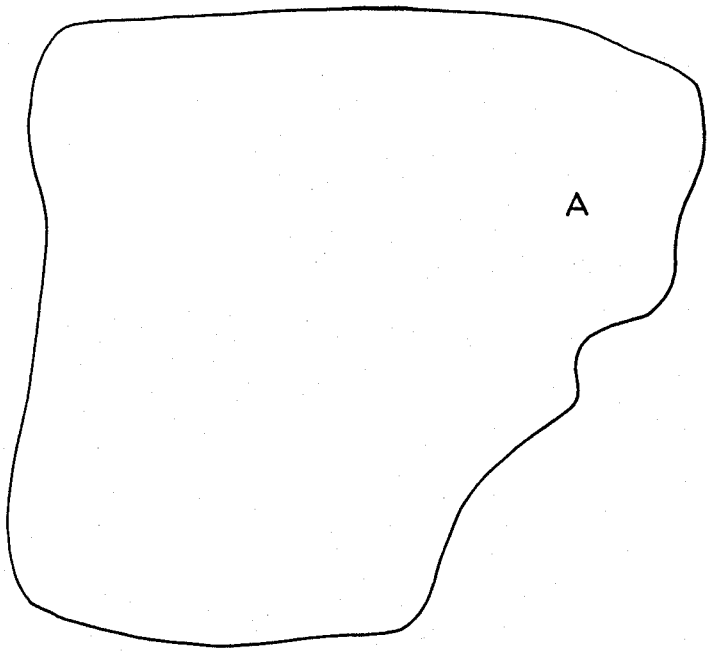

This invention relates to anti-photocopying and anti-telefacsimile paper, that is to say paper which when carrying information in a conventional black or similar dark color cannot be readily photocopied or transmitted by telefacsimile in a visually readable manner.

The present day availability of improved photocopiers has increased the problem of rendering documents or portions thereof resistant to photocopying in a readable manner. Anti-photocopying paper which is successful in preventing visually readable photocopying by most present day photocopiers is described in U.S. Pat. No. 4,522,429 (Gardner et al) issued June 11, 1985 and U.S. Pat. No. 4,632,429 (Gardner et al) issued Dec. 30, 1986.

U.S. Pat. No. 4,522,429 teaches the use of anti-photocopying paper having a colour with a reflection spectral response of less than about 10% for light with a wavelength below about 600 millimicrons and yet which is sufficiently visually contrasting with information, when such information is typed thereon or otherwise applied thereto, to enable such information to be read by the human eye when the paper is viewed under white light.

U.S. Pat. No. 4,632,429 teaches the use of anti-photocopying paper with a front face having a colour with a reflection spectral response which is effectively zero for light with a wavelength below about 625 millimicrons and less than about 1% up to about 1,000 millimicrons so as to render the paper substantially incapable of being photocopied in an information readable manner, after substantially non-translucent information has been typed or otherwise applied to the front face, the paper being capable of transmitting visible light from a rear face to the front face to cause sufficient contrast between the substantially non-translucent information and the transmitted light to enable the information to be read by a human eye viewing the front face of the paper when visible light is transmitted through the paper from the rear face to the front face thereof.

Anti-photocopying paper of the type described in the above mentioned patents satisfactorily fulfills most present day needs, and represents a very significant improvement over prior proposals which were not successful in practice. Such paper is also resistant to transmission by telefacsimile. However, the increasing photocopying ability of new generation photocopiers presents a need for still further improved anti-photocopying paper. Some photocopiers which are now becoming available are capable of wider spectral response and improved resolution between the information and the information background compared to existing photocopiers. There is also a need for paper which is more resistant to transmission of information thereon by telefacsimile.

It is therefore an object of the present invention to provide improved anti-photocopying and anti-telefacsimile paper.

According to the present invention, an improved anti-photocopying and anti-telefacsimile effect is achieved by spatial spectral modulation of the paper reflectance at a specific single or preferably multiple spatial frequencies.

The present invention provides anti-photocopying and anti-telefacsimile paper having a colored pattern of at least one pair of colors repeating in at least one dimension of a face of a paper with at least one spatial frequency in the range of from about 0.5 to about 50 times per cm., the colors of each pair having substantially the same spectral profile but with one color having a lower spectral response that the other color over substantially all wavelengths, said colors contrasting with black or similar dark color to permit black or similar dark colored information to be visibly readable when applied to the colored pattern, said colors also cooperating with such information to provide a document resistant to photocopying.

When the paper is primarily intended for use with textual information, the colored pattern may repeat with a spatial frequency in the range of from about 2 to about 25 time per cm., preferably from about 4 to about 10 times per cm.

When the paper is primarily intended for graphical or pictorial information, the colored pattern may repeat with a spatial frequency in the range of from about 0.5 to about 10 times per cm., preferably from about 1 to about 5 times per cm.

The colored pattern may repeat with multiple spatial frequencies including a higher spatial frequency comparable to the higher fourier spatial frequency of information of a predetermined kind and a lower spatial frequency comparable to the lower fourier spatial frequency of such information. "Comparable" in this context means up to three times greater or smaller.

When the information is textual, the higher spatial frequency may be in the range of from about 40 to about 50 times per cm., and the lower spatial frequency may be in the range of from about 2 to about 5 times per cm.

When the information is graphical or pictorial, the higher spatial frequency may be in the range of from about 10 to about 25 times per cm., preferably from about 15 to about 25 times per cm., and the lower spatial frequency may be in the range of from about 0.5 to about 5 times per cm., preferably from about 0.5 to about 2 times per cm.

One of the colors of a pair of said colors may have a reflection spectral response with a minimum of about 5% at lower visible wavelengths of about 400 nanometers, rising to about 10% at a wavelength of about 580 nanometers, and then rising to a maximum of about 20% at a wavelength of about 700 nanometers, with the other color of the pair having a reflecting spectral response with a minimum of about 4% at lower visible wavelengths of about 400 nanometers, rising to about 6% at a wavelength of about 580 nanometers, and then rising to a maximum of about 12% at a wavelength of about 700 nanometers. Advantageously, the reflection spectral response of said colors falls to said minima at wavelengths above about 700 nanometers.

Alternatively or additionally, one of the colors of a pair of said colors may have a reflection spectral response with a maximum of about 20% at lower visible wavelengths of about 400 nanometers, falling to about 10% at a wavelength of about 480 nanometers, and falling to a minimum of about 8% at higher wavelengths, with the other color of the pair having a reflection spectral response with a maximum of about 12% at lower visible wavelengths, of about 400 nanometers falling to about 6% at a wavelength of about 480 nanometers, and falling to a minimum of about 5% at higher wavelengths. Advantageously, the reflection spectral response of said colors falls to said minimum at wavelengths below about 400 nanometers.

The colored pattern may include an additional color of relatively high reflectivity repeating in at least one dimension of a face of the paper with at least one spatial frequency in the range of from about 0.5 to about 50 times per cm. to improve readability of information on the paper with the paper still being resistant to photocopying.

Embodiments of the invention will now be described, by way of example, with reference to the accompanying drawings of which:

FIG. 1 is a plan view of a sheet of paper with a front face having a first colour A.

Figure 2:
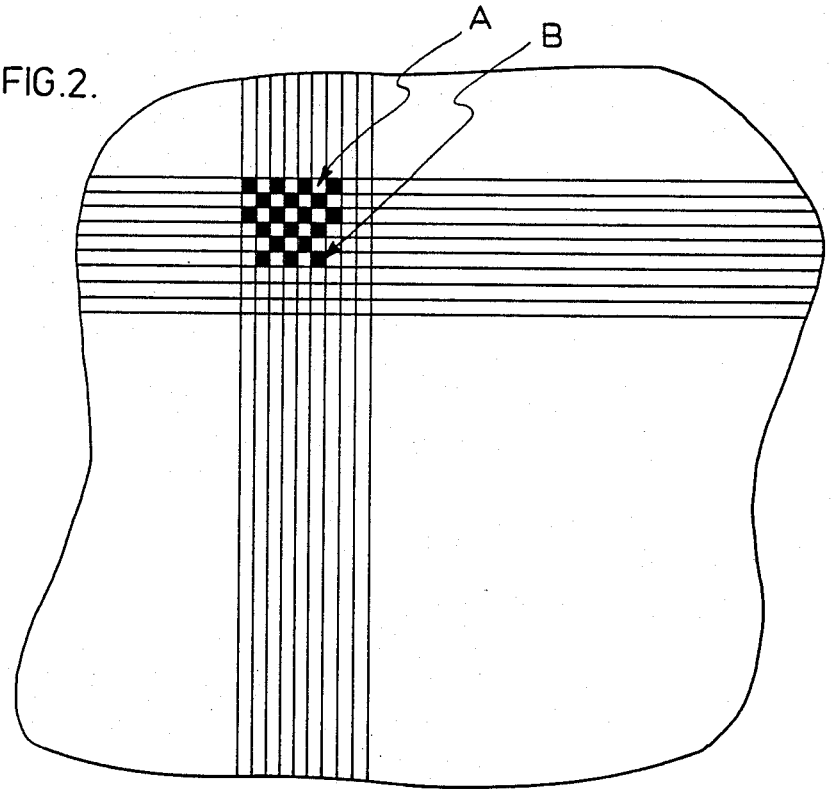
Figure 3:
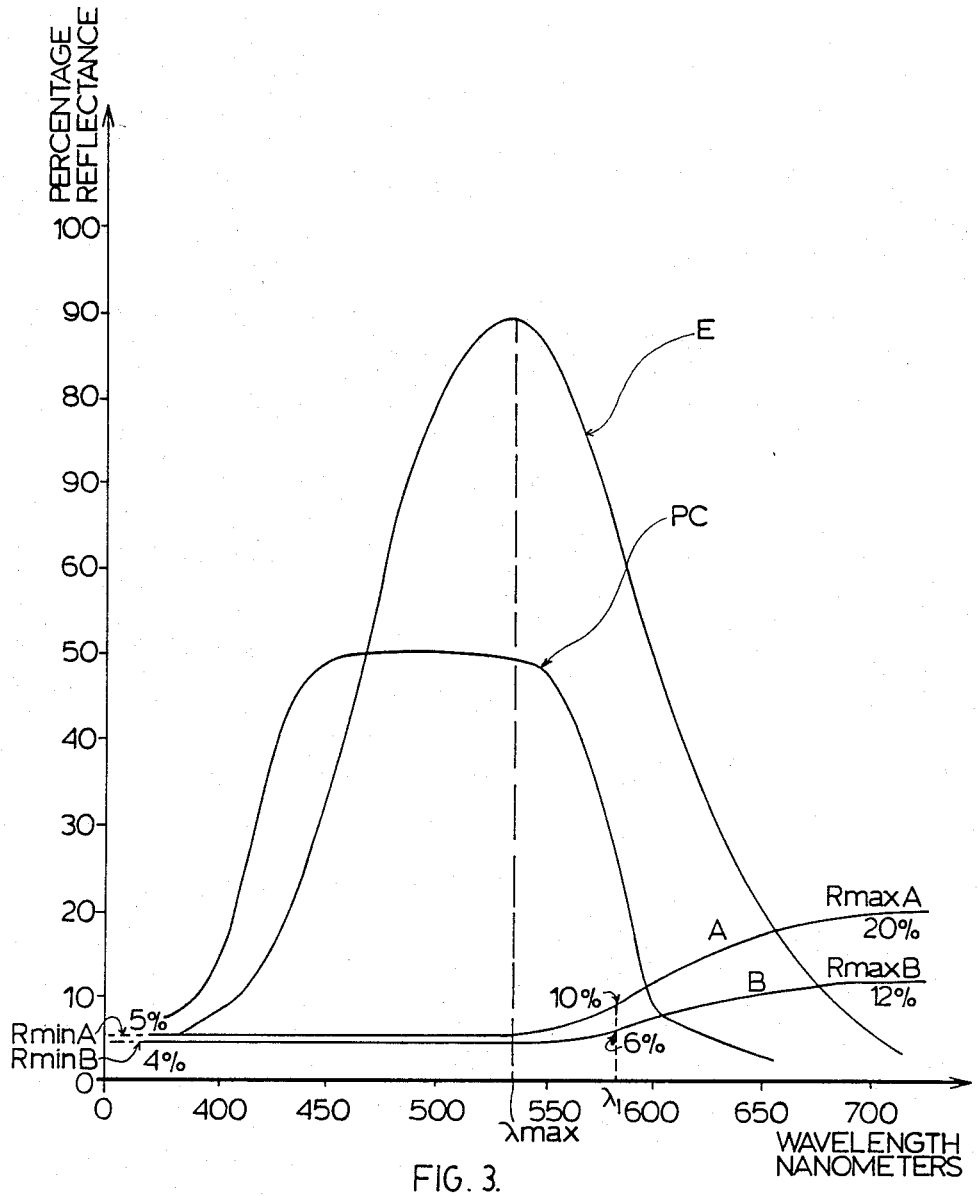
Figure 4:
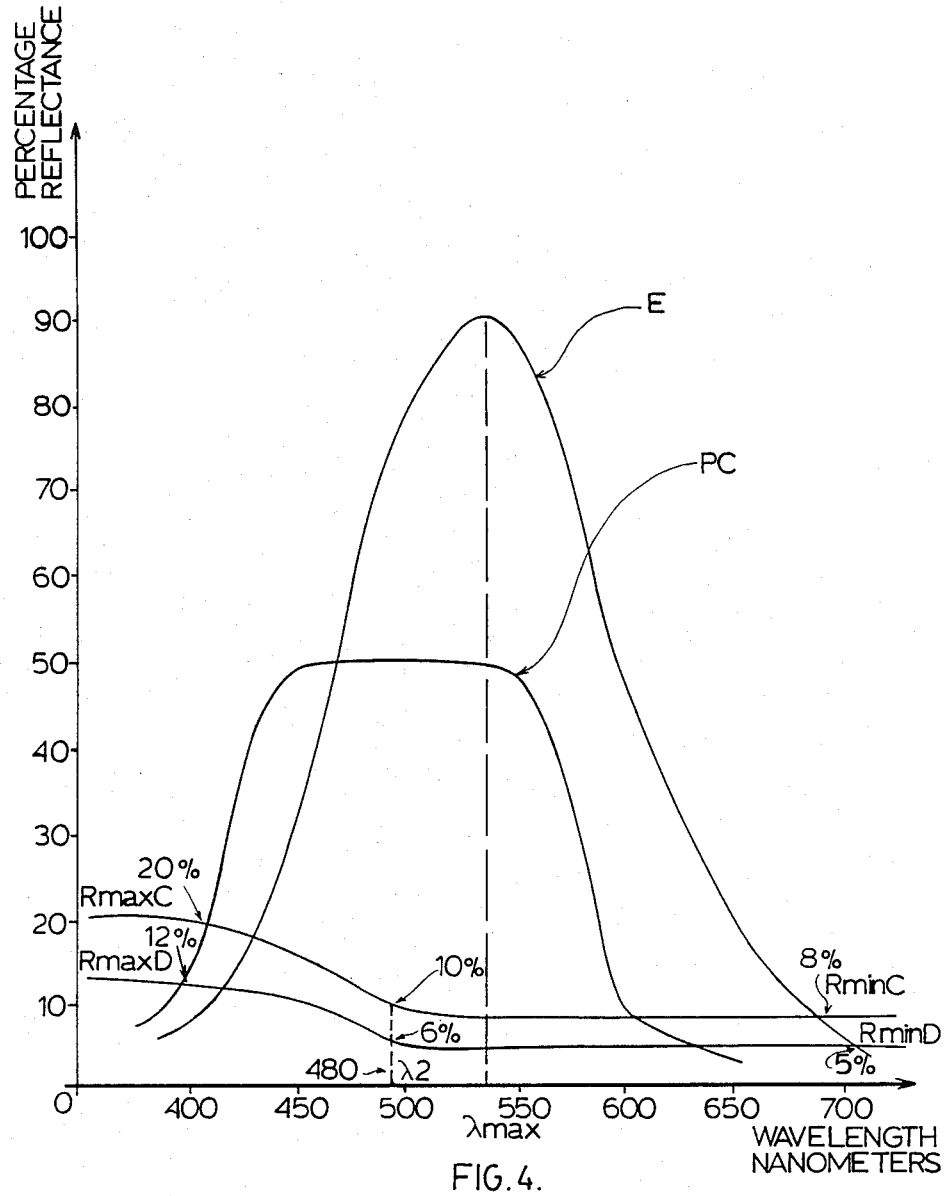
Figure 5:
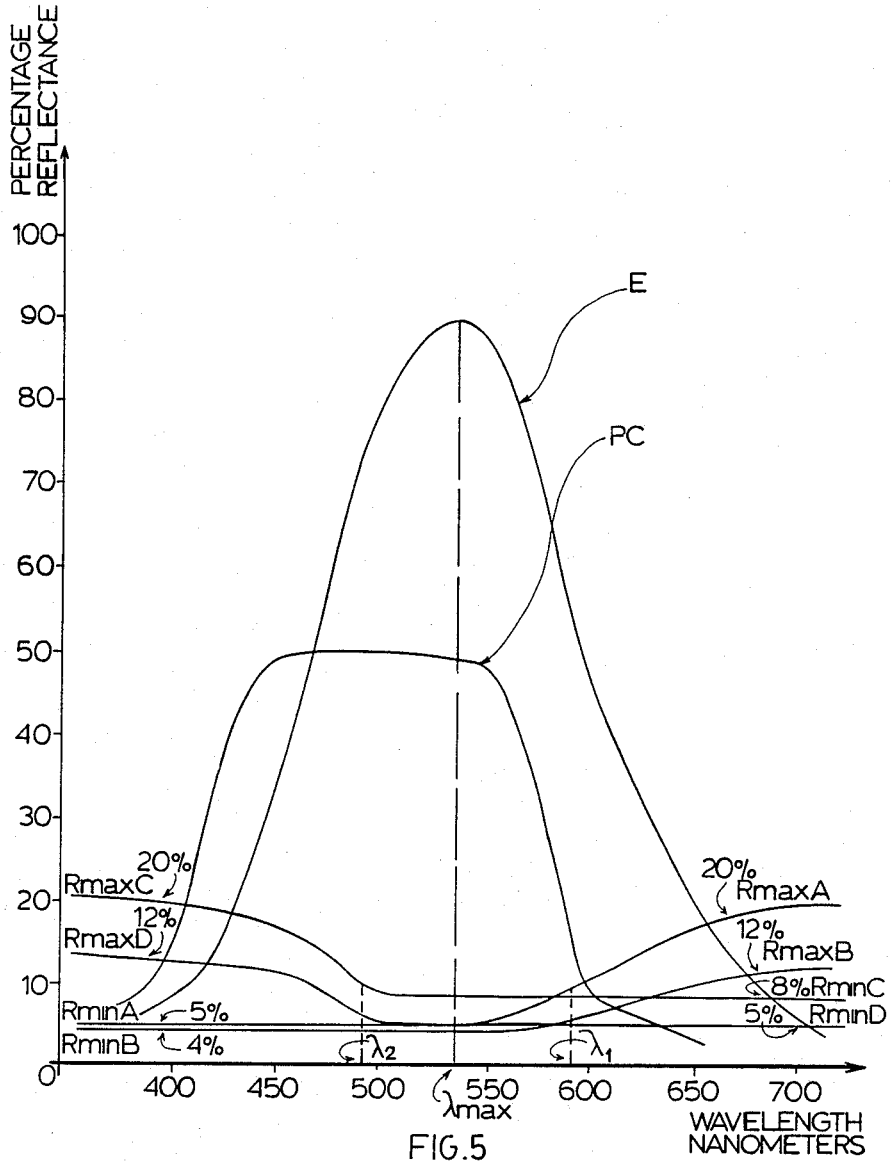
Figure 6:
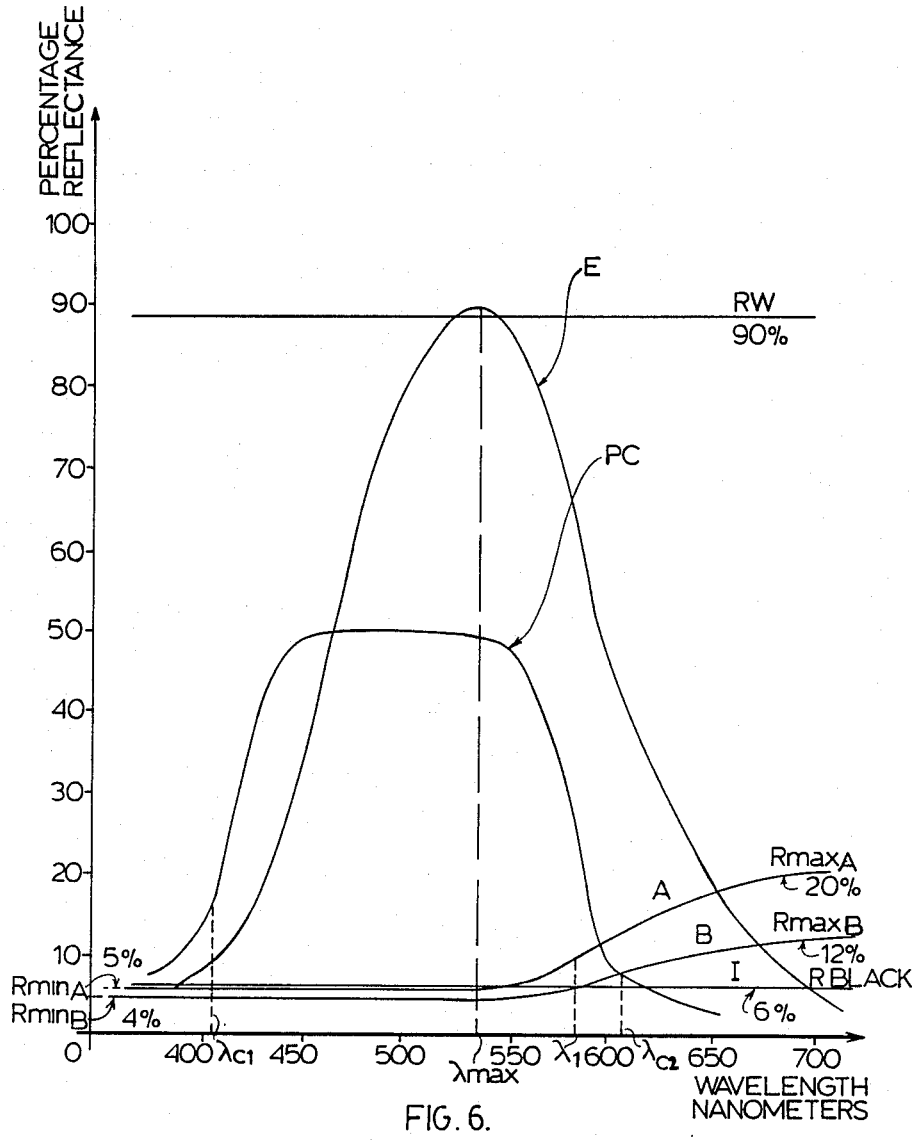
Figure 7:
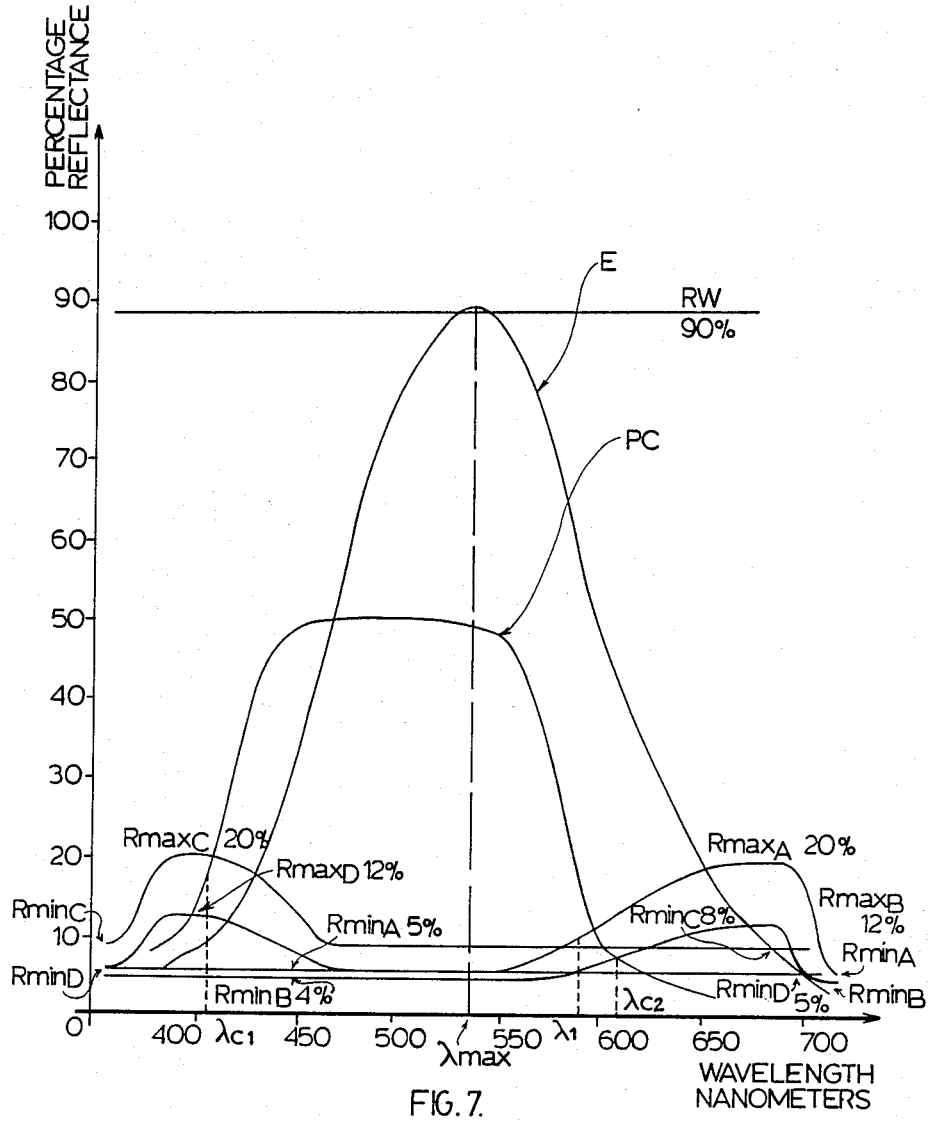

FIG. 2 is a similar view having a second color B applied to form a colored pattern of the part of colors A and B in accordance with one embodiment of the invention, FIG. 3 is a graph showing the reflection spectral response of the two colors A and B, and also showing the average spectral response of the human eye and a typical spectral response of a photocopier, FIG. 4 is a graph similar to FIG. 3 but showing reflection spectral responses of an alternative pair of colors C and D in accordance with another embodiment, FIG. 5 is a graph similar to FIG. 3 but also showing the reflection spectral responses of colors C and D, FIG. 6 is a graph similar to FIG. 3 but also showing the reflection spectral response of black information and a highly reflective colour W, and FIG. 7 is a graph similar to FIG. 5 but showing another embodiment.

Referring to the accompanying drawings, FIG. 1 shows a top face of a sheet of paper which has been colored uniformly with a colour A during or after manufacture, the colour A having the spectral response indicated as line A in FIG. 3. It will be noted that the reflection spectral response is a minimum (R min A) of about 5% at a wavelength of about 400 nanometers (millimicrons), rises gradually to about 10% at about 580 nanometers, such a wavelength being known as the cut off wavelength, and then rises to a maximum (R max A) of about 20% at a wavelength of about 700 nanometers.

The sheet face coloured A is then overprinted with another color B in a grid-like configuration, using an appropriately configured printing plate, to provide a colored grid-like pattern in which two colors A and B forming a pair alternate in both dimensions of the face of the paper. Color B is the result of overprinting color A with another color, the other color being such as to provide color B with a reflection spectral response indicated by line B in FIG. 3.

Color A and color B have substantially the same spectral profile but the reflection spectral response colour B is less than that of color A, with a minimum (R min B) of about 4% for a wavelength of about 400 nanometers, rising to about 6% at a wavelength of about 580 nanometers, and maximum (R max B) of about 12% at about 700 nanometers. The average spectral response of the human eye is shown by the line E, and the reflection spectral response of a typical photocopier is shown by the line PC.

In this embodiment, the frequency of the pattern repeats is approximately the same in both directions of the colored face of the paper and is approximately 10 per cm.

FIGS. 4 and 5 show the reflection spectral responses of another pair of colors C and D, with the colors C and D having substantially the same spectral profile but with the spectral response of colour D being less than that of color C. The spectral response of color C is a maximum (R max C) of about 20% at low visible wavelengths of about 400 nanometers, falling to about 10% at a cut off wavelengths of about 480 nanometers and a minimum (R min C) of about 8% at higher visible wavelengths. Color D has a reflection spectral response with a maximum (R max D) of about 12% at lower visible wavelengths of about 400 nanometers, falling to about 6% at about 480 nanometers and a minimum (R min D) of about 5% at higher visible wavelengths.

The color pattern may comprise changes from color C to color D, but may also include changes from color A to color B to color C and to color D in each pattern, with such a pattern being produced for example by overprinting with successive plates, with each plate being appropriately displaced to provide the required different positioning of difference colors in the pattern. The colored pattern may in fact change from one colour to another in any desired manner. Also, if desired, each color may be built up by the application of more than one layer of the same color.

The production of the colored pattern can thus be carried out in a multi-color printing facility. It will be appreciated that this is essentially a multi-layer optical filtering technique with each layer providing a different spectral and spatial characteristic. The superposition of the required number of layers thus results in the overall spectral characteristics shown in FIG. 5.

FIG. 6 shows the reflection spectral response ($^{R}$Black) of typical black information I printed or otherwise applied to paper, $^{R}$Black being about 6% across the entire spectral range. When an attempt is made to photocopy such a document with a photocopier having a typical response PC, the photocopier will perceive enough contrast in those portions of information I which fall on background of color A but will fail to "see" any contrast where portions of information I fall on background of color B and will therefore fail to reproduce such portions of information I. The photocopy thus obtained will show at least traces of information I in the form of a scrambled and unreadable version of information I. The scrambling of the photocopy will be effective over a large range of photocopiers which may have upper cut off wavelengths somewhat beyond 600 nanometers ($\lambda_{C2}$).

However, for photocopiers with upper cut off wavelengths substantially beyond 600 nanometers, for example up to 700 nanometers or beyond in the infrared range, paper with a color pattern of colors C and D is preferable, such photocopiers typically having color cut off wavelengths around 400 nanometers ($\lambda_{C1}$).

Thus, anti-photocopying paper with a color pattern comprising permutations of color A, B, C and D is preferable because it provides anti-photocopying resistance to a wide range of photocopiers.

The black information I is visible to the human eye because of the contrast between the color of information I and colors A, B, C and D within the range of the eye sensitivity curve E at either the long wavelength or short wavelength ends of curve E.

It has been observed that the visibility to the human eye, i.e. the readability, of information I on the original document can be dramatically improved by superimposing on any anti-photocopying background a spectral color modulation or pattern, at frequencies similar to those previously mentioned, with a highly reflective color W such as light green, yellow or even white with a reflectance $R_w$ of the order of 90% (see FIG. 6).

Although those portions of information I which fall upon background of color W will be easily reproduced by a photocopier, the spectral modulation of color W will also be reproduced with a resultant further scrambling effect. However, the presence of the highly reflective pattern of colour W will increase the average reflectivity of the paper and this will make the paper appear lighter or "whiter". This is thus a very important step in achieving the desirable goal of producing an anti-photocopying paper which is as light colored as possible.

According to a further embodiment as shown in FIG. 7, colors A and B are modified so that their reflectance falls to the R min $_A$ and R min $_B$ level at a wavelength of about 700 nanometers and beyond. Colors C and D are modified so that their reflectance falls to the R in $_C$ and R in $_D$ level at a wavelength of about 400 nanometers and lower.

Resistance to photocopying in accordance with the invention is accordingly widened even further to cover photocopiers which operate in the infrared or ultraviolet regions of the spectrum. In other words, $\lambda_{C2}$ is shifted in the direction of 700 nanometers and beyond, and $\lambda_{C1}$ is shifted in the direction of 400 nanometers and lower.

The colored pattern may of course only be applied to a portion of a paper document if it is desired to render resistant to photocopying only information appearing or intended to appear on that portion.

The comments which have been made above with respect to resistance to photocopying also apply to resistance to transmission by telefacsimile.

Other embodiments of the invention will be readily apparent to a person skilled in the art, the scope of the invention being defined in the appended claims.

I claim:

1. Anti-photocopying and anti-telefacsimile paper having a colored pattern of at least one pair of colors repeating in at least one dimension of a face of a paper with at least one spatial frequency in the range of from about 0.5 to about 50 time per cm., the colors of each pair having substantially the same spectral profile but with one color having a lower spectral response than the other color over substantially all wavelengths, said colors contrasing with black or similar dark color to permit black or similar dark colored information to be visibly readable when applied to the colored pattern, said colors also cooperating with such information to provide a documents resistant to photocopying.

2. Paper according to claim 1 wherein the colored pattern repeats with a spatial frequency in the range of from about 2 to about 25 times per cm.

3. Paper according to claim 2 wherein the colored pattern repeats with a spatial frequency in the range of from about 4 to about 10 times per cm.

4. Paper according to claim 1 wherein the colored pattern repeats with a spatial frequency in the range of from about 0.5 to about 10 times per cm.

5. Paper according to claim 4 wherein the colored pattern repeats with a spatial frequency in the range of from about 1 to about 5 times per cm.

6. Paper according to claim 1 wherein the colored pattern repeats with multiple spatial frequencies including a higher spatial frequency comparable to the higher fourier spatial frequency of information of a predetermined kind and a lower spatial frequency comparable to the lower fourier spatial frequency of such information, said higher and lower spatial frequencies being comparable to the highest and lowest fourier spatial frequencies respectively of textual information, said higher fourier spatial frequency being in the range of from about 40 to about 50 times per cm. and said lower fourier spectral frequency being in the range of from about 2 to about 5 times per cm.

7. Paper according to claim 1 wherein the colored pattern repeats with multiple spatial frequencies including a higher spatial frequency comparable to the higher fourier spatial frequency of information of a predetermined kind and a lower spatial frequency comparable to the lower spatial frequency of such information, said higher and lower spatial frequencies being comparable to the highest and lowest fourier spatial frequencies respectively of graphical or pictorial information, said higher spatial frequency being in the range of from about 10 to about 15 times per cm., and said lower spatial frequency being in the range of from about 0.5 to about 5 time per cm.

8. Paper according to claim 7 wherein said higher spatial frequency is in the range of from about 15 to about 25 times per cm., and said lower spatial frequency is in the range of from about 0.5 to about 2 times per cm.

9. Paper according to claim 1 wherein one color of a pair of said colors has a reflection spectral response with a minimum of about 5% at lower visible wavelengths of about 400 nanometers, rising to about 10% at a wavelength of about 580 nanometers, and then rising to a maximum of about 20% at a wavelength of about 700 nanometers, and the other color of said pair of colors has a reflection spectral response with a minimum of about 4% at lower visible wavelengths of about 400 nanometers, rising to about 6% at a wavelength of about 580 nanometers, and then rising to a maximum of about 12% at a wavelength of about 700 nanometers.

10. Paper according to claim 9 wherein the reflection spectral response of said pair of colors falls to said minima at wavelengths above about 700 nanometers.

11. Paper according to claim 1 wherein one color of a pair of said colors has a reflection spectral response with a maximum of about 20% at lower visible wavelengths of about 400 nanometers, falling to about 10% at a wavelength of about 480 nanometers, and falling to a minimum of about 8% at higher wavelengths, and the other color of said pair of colors has a reflection spectral response with a maximum of about 12% at lower visible wavelengths of about 400 nanometers, falling to about 6% at a wavelength of about 480 nanometers, and falling to a minimum of about 5% at higher wavelengths.

12. Paper according to claim 11 wherein the reflection spectral response of said pair of colors falls to said minima at wavelengths below about 400 nanometers.

13. Paper according to claim 9 wherein one color of a further pair of said colors has a reflection spectral response with a maximum of about 20% at lower visible wavelengths of about 400 nanometers, falling to about 10% at a wavelength of about 480 nanometers, and falling to a minimum of 8% at higher wavelengths, and the other color of said further pair of colors has a reflection spectral response with a maximum of about 12% at lower visible wavelengths of about 400 nanometers, falling to about 6% at a wavelength of about 480 nanometers, and falling to a minimum of about 5% at higher wavelengths.

14. Paper according to claim 1 wherein said colored pattern includes an additional color of relatively high reflectivity repeating in at least one dimension of a face of the paper with at least one spatial frequency in the range of from about 0.5 to about 50 times per cm. to improve readability of information on the paper with the paper still being resistant to photocopying.

15. Paper according to claim 13 wherein the reflection spectral response of said colors of said first pair of colors falls to said minima at wavelengths above about 700 nanometers, and the reflection spectral response of said colors of said further pair of colors falls to said minima at wavelengths below about 400 nanometers.

* * * * *